US009056501B2

(12) United States Patent
Masuda et al.

(10) Patent No.: US 9,056,501 B2
(45) Date of Patent: Jun. 16, 2015

(54) METHOD AND DEVICE FOR CONTROLLING A RECORDING MEDIUM IN A PRINTING DEVICE

(75) Inventors: Ichimi Masuda, Shiojiri (JP); Masayuki Nakagawa, Suwa (JP)

(73) Assignee: Seiko Epson Corporation, Tokyo (JP)

( * ) Notice: Subject to any disclaimer, the term of this patent is extended or adjusted under 35 U.S.C. 154(b) by 425 days.

(21) Appl. No.: 13/559,939

(22) Filed: Jul. 27, 2012

(65) Prior Publication Data

US 2013/0044151 A1 Feb. 21, 2013

(30) Foreign Application Priority Data

Aug. 15, 2011 (JP) ..... 2011-177420

(51) Int. Cl.
*B41J 29/38* (2006.01)
*B41J 11/00* (2006.01)
*B41J 13/00* (2006.01)

(52) U.S. Cl.
CPC ..... *B41J 11/0095* (2013.01); *B41J 13/0009* (2013.01)

(58) Field of Classification Search
CPC ..... B41J 13/0009; B41J 11/0095
USPC ..... 347/16; 271/265.01
See application file for complete search history.

(56) References Cited

U.S. PATENT DOCUMENTS 5,544,965 A 8/1996 Kamoda et al.
2011/0309571 A1* 12/2011 Mizuno et al. ..... 271/265.01

FOREIGN PATENT DOCUMENTS

JP 64-020178 A 1/1989
JP 2000-016656 A 1/2000
JP 2004-322619 A 11/2004

* cited by examiner

*Primary Examiner* — Julian Huffman
*Assistant Examiner* — Carlos A Martinez
(74) *Attorney, Agent, or Firm* — Nutter McClennen & Fish LLP; John J. Penny, Jr.; Joshua L. Rudawitz

(57) ABSTRACT

A control method that conveys a recording medium fed from a first conveyance unit a specific number of paper feed steps after the leading end is detected by a first detection unit, and stops conveyance after conveying the leading end of the recording medium passed the second conveyance unit, second detection unit, and print unit to an initial printing position has a reference distance acquisition step that gets a reference number of conveyance steps equal to the distance between the second detection unit and the initial printing position in the specific number of conveyance steps; an actual step count measurement step that measures an actual number of steps the recording medium is conveyed during actual conveyance from detection of the leading end by the second detection unit until conveyance stops; and an evaluation step that determines if paper feed error occurred when conveying the recording medium.

5 Claims, 5 Drawing Sheets

METHOD AND DEVICE FOR CONTROLLING A RECORDING MEDIUM IN A PRINTING DEVICE

Priority is claimed under 35 U.S.C. §119 to Japanese Application nos. 2011-177420 filed on Aug. 15, 2011 which is hereby incorporated by reference in their entirety.

BACKGROUND

1. Technical Field

The present invention relates to a method of controlling a printing device that stops the recording medium at an initial printing position (start printing position) before the print unit after feeding a recording medium from a first conveyance unit to a second conveyance unit.

2. Related Art

Printers that convey a print medium (recording medium) using a platen (platen roller) disposed opposite a printhead unit, a tractor mechanism located on the upstream side of the platen, and a discharge roller located on the downstream side of the platen, are known from the literature. See, for example, Japanese Unexamined Patent Appl. Pub. JP-A-2000-16656. The printer described in JP-A-2000-16656 adjusts the paper feed distance in steps according to a correction amount previously determined in tests in order to remove slack in the print medium between the tractor mechanism and the discharge roller when initially feeding the print medium.

If irregular printing paper that is shorter than the distance between the tractor mechanism and the platen is mistakenly inserted to such a printer according to the related art, the paper cannot be desirably passed between the tractor mechanism and the platen, media conveyance cannot be corrected as described above, and printing as desired is not possible. If a sensor is not provided near the platen in this case, paper feed errors cannot be detected and problems such as printing directly on the platen or the paper becoming jammed may occur.

SUMMARY

A method of controlling a printing device and a printing device according to the present invention enable desirably processing the recording medium even when a recording medium that is shorter than the distance between the first conveyance unit and the second conveyance unit is inserted.

One aspect of the invention is a method of controlling a printing device that has a first conveyance unit, first detection unit, second conveyance unit, second detection unit, and print unit disposed sequentially from the upstream side of the recording medium conveyance direction, conveys the recording medium fed from the first conveyance unit a specific conveyance distance after the leading end is detected by the first detection unit, and stops conveyance after conveying the leading end of the recording medium passed the second conveyance unit, second detection unit, and print unit to an initial printing position. The control method includes: a first reference distance acquisition step that gets a first reference conveyance distance equal to the distance between the second detection unit and the initial printing position in the specific conveyance distance; a first actual distance measurement step that measures the first actual conveyance distance of the recording medium during actual conveyance from detection of the leading end by the second detection unit until conveyance stops; and an evaluation step that compares the first reference conveyance distance and the first actual conveyance distance, and determines if conveyance error occurred during recording medium conveyance.

This aspect of the invention compares a first reference conveyance distance equal to the distance between the second detection unit and the initial printing position with a first actual conveyance distance of the recording medium from detection of the leading end by the second detection unit until conveyance stops. If the first reference conveyance distance and the first actual conveyance distance are equal in this comparison, the evaluation unit determines the recording medium was conveyed correctly, and determines the recording medium was conveyed too far or not enough if the distances differ. The result of this comparison can then be used to desirably process (handle) the recording medium when a recording medium that is shorter than the distance between the first conveyance unit and second conveyance unit is inserted by mistake, for example. These conveyance distances can be expressed by the number of steps driven when a stepper motor is used for conveyance, or by the pulse count when a rotary encoder is used for detection, for example.

Preferably, the evaluation step determines conveyance error occurred if the first actual conveyance distance is greater than or less than the first reference conveyance distance.

Further preferably, the control method also has a cancellation step that cancels printing by the print unit when conveyance error occurs.

This aspect of the invention can prevent printing before the leading end of the recording medium or creating a margin that is greater than the desired margin at the leading end of the recording medium. This is particularly desirable because printing outside the print area using an inkjet print unit soils the recording medium or the inside of the printer, and damages the platen when using a thermal print unit.

Further preferably, the control method also has a complementary conveyance step that conveys the recording medium an additional remaining conveyance distance equal to the first reference conveyance distance minus the first actual conveyance distance when conveyance error is detected because the first actual conveyance distance is less than the first reference conveyance distance.

By calculating the remaining conveyance distance that the recording medium was not conveyed and then additionally conveying the recording medium this distance, printing can be completed desirably even when the recording medium is not fed enough because the recording medium is short.

A control method for a printing device according to another aspect of the invention is a method of controlling a printing device that has a first conveyance unit, first detection unit, second conveyance unit, second detection unit, and print unit disposed sequentially from the upstream side of the recording medium conveyance direction, conveys the recording medium fed from the first conveyance unit a specific conveyance distance after the leading end is detected by the first detection unit, and stops conveyance after conveying the leading end of the recording medium passed the second conveyance unit, second detection unit, and print unit to an initial printing position. The control method includes: a second reference distance acquisition step that gets a second reference conveyance distance equal to the distance between the first detection unit and second detection unit in the specific conveyance distance; a second actual distance measurement step that measures the second actual conveyance distance of the recording medium during actual conveyance from detection of the leading end by the first detection unit to detection of the leading end by the second detection unit; and an evaluation step that compares the second reference conveyance distance and the second actual conveyance distance, and determines if conveyance error occurred during recording medium conveyance.

This aspect of the invention compares a second reference conveyance distance equal to the distance between the first detection unit and second detection unit with a second actual conveyance distance of the recording medium from detection of the leading end by the first detection unit to detection of the leading end by the second detection unit. If the second reference conveyance distance and the second actual conveyance distance are the same in this comparison, the evaluation unit determines the recording medium was conveyed correctly, and determines the recording medium was conveyed too far or not enough if the distances differ. The result of this comparison can then be used to desirably process (handle) the recording medium when a recording medium that is shorter than the distance between the first conveyance unit and second conveyance unit is inserted by mistake, for example.

Preferably, the evaluation step determines conveyance error occurred if the second actual conveyance distance is greater than or less than the second reference conveyance distance.

Further preferably, the method of controlling a printing device also has a cancellation step that cancels printing by the print unit when conveyance error occurs.

This aspect of the invention can prevent printing before the leading end of the recording medium or creating a margin that is greater than the desired margin at the leading end of the recording medium. This is particularly desirable because printing outside the print area using an inkjet print unit soils the recording medium or the inside of the printer, and damages the platen when using a thermal print unit.

Further preferably, the method of controlling a printing device also has a complementary conveyance step that conveys the recording medium an additional remaining conveyance distance equal to the second actual conveyance distance minus the second reference conveyance distance when conveyance error is detected because the second actual conveyance distance is greater than the second reference conveyance distance.

By calculating the remaining conveyance distance that the recording medium was not conveyed and then additionally conveying the recording medium this distance, printing can be completed desirably even when the recording medium is not fed enough because the recording medium is short.

Further preferably, the complementary conveyance step conveys the additional distance at a lower speed than the conveyance speed when conveying the specific conveyance distance.

This aspect of the invention avoids a further conveyance deficiency due to slipping when additionally conveying the recording medium, and enables desirably conveying the recording medium the additional amount.

Another aspect of the invention is a printing device including: a first conveyance unit, first detection unit, second conveyance unit, second detection unit, and print unit disposed sequentially from the upstream side of the recording medium conveyance direction; and a control unit that conveys the recording medium fed from the first conveyance unit a specific conveyance distance after the leading end is detected by the first detection unit, and stops conveyance after conveying the leading end of the recording medium passed the second conveyance unit, second detection unit, and print unit to an initial printing position. The control unit also has a first reference distance acquisition unit that gets a first reference conveyance distance equal to the distance between the second detection unit and the initial printing position in the specific conveyance distance, a first actual distance measurement unit that measures the first actual conveyance distance of the recording medium during actual conveyance from detection of the leading end by the second detection unit until conveyance stops, and an evaluation unit that compares the first reference conveyance distance and the first actual conveyance distance, and determines if conveyance error occurred during recording medium conveyance.

This aspect of the invention compares a first reference conveyance distance equal to the distance between the second detection unit and the initial printing position with a first actual conveyance distance of the recording medium from detection of the leading end by the second detection unit until conveyance stops. If the first reference conveyance distance and the first actual conveyance distance are equal in this comparison, the evaluation unit determines the recording medium was conveyed correctly, and determines the recording medium was conveyed too far or not enough if the distances differ. The result of this comparison can then be used to desirably process (handle) the recording medium when a recording medium that is shorter than the distance between the first conveyance unit and second conveyance unit is inserted by mistake, for example.

Another aspect of the invention is a printing device including: a first conveyance unit, first detection unit, second conveyance unit, second detection unit, and print unit disposed sequentially from the upstream side of the recording medium conveyance direction; and a control unit that conveys the recording medium fed from the first conveyance unit a specific conveyance distance after the leading end is detected by the first detection unit, and stops conveyance after conveying the leading end of the recording medium passed the second conveyance unit, second detection unit, and print unit to an initial printing position. The control unit also includes a second reference distance acquisition unit that gets a second reference conveyance distance equal to the distance between the first detection unit and second detection unit in the specific conveyance distance, a second actual distance measurement unit that measures the second actual conveyance distance of the recording medium during actual conveyance from detection of the leading end by the first detection unit to detection of the leading end by the second detection unit, and an evaluation unit that compares the second reference conveyance distance and the second actual conveyance distance, and determines if conveyance error occurred during recording medium conveyance.

This aspect of the invention compares a second reference conveyance distance equal to the distance between the first detection unit and second detection unit with a second actual conveyance distance of the recording medium from detection of the leading end by the first detection unit to detection of the leading end by the second detection unit. If the second reference conveyance distance and the second actual conveyance distance are the same in this comparison, the evaluation unit determines the recording medium was conveyed correctly, and determines the recording medium was conveyed too far or not enough if the distances differ. The result of this comparison can then be used to desirably process (handle) the recording medium when a recording medium that is shorter than the distance between the first conveyance unit and second conveyance unit is inserted by mistake, for example.

Other objects and attainments together with a fuller understanding of the invention will become apparent and appreciated by referring to the following description and claims taken in conjunction with the accompanying drawings.

DESCRIPTION OF EMBODIMENTS

Preferred embodiments of a printing system according to the present invention are described below with reference to the accompanying figures.

Figure 1:
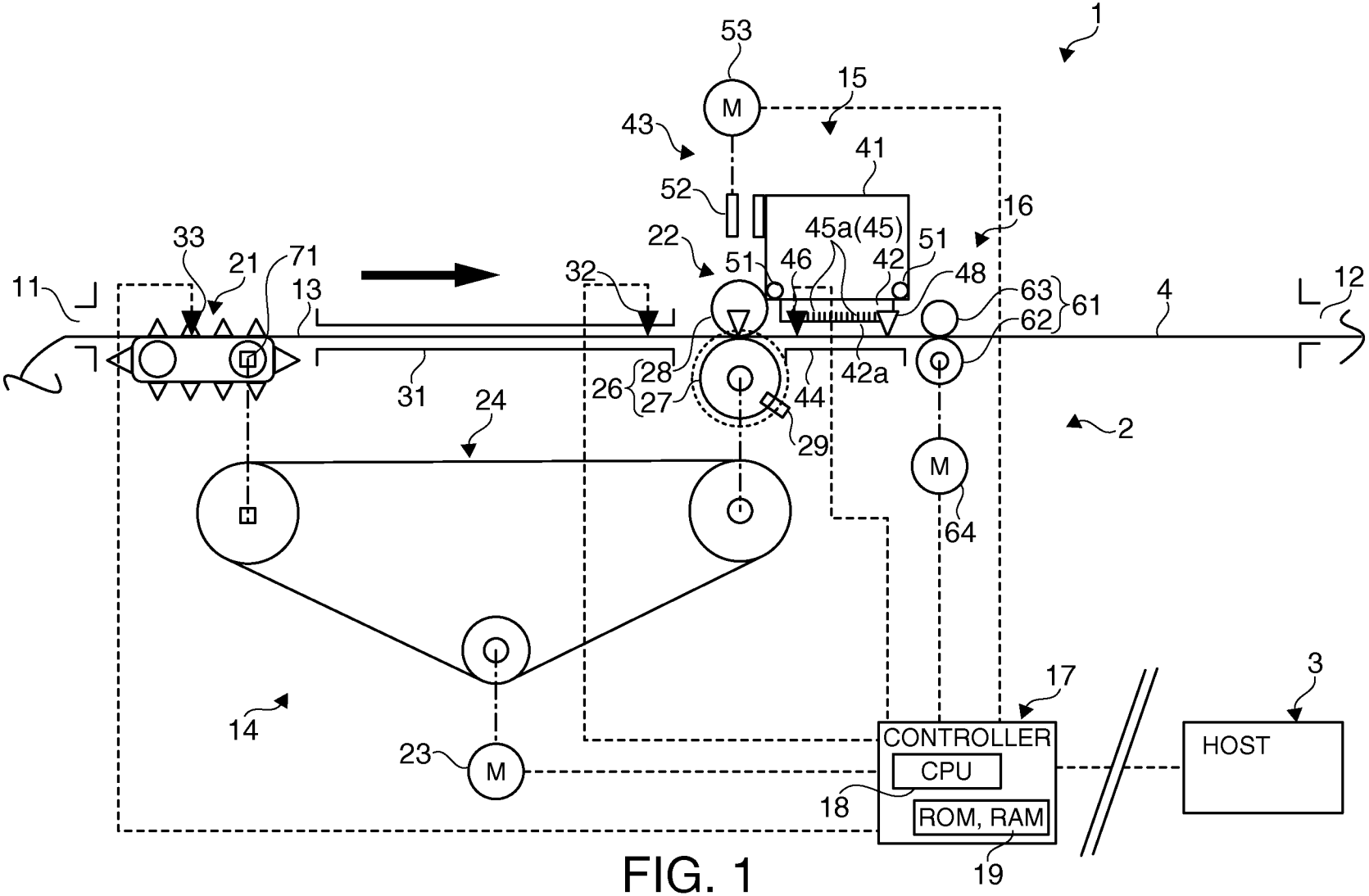
FIG. 1 describes a printing system according to a preferred embodiment of the invention.

FIG. 1 describes a printing system built around a printing device. As shown in the figure, the printing system 1 includes a printer 2 such as an inkjet printer, and a host computer 3 connected through an interface to the printer 2. The printer 2 prints on tractor feed paper ("recording medium" below) 4, and executes a desired media conveyance operation (paper feed operation) based on control commands while printing based on print jobs received from the host computer 3. The printer 2 according to this embodiment of the invention is not limited to using perforated continuous paper as the recording medium 4, and can also print on single sheets with sprocket holes.

As shown in FIG. 1, the printer 2 has a conveyance path 13 that extends substantially horizontally from a paper entrance 11 to a paper exit 12, and a media conveyance unit 14, a print unit 15, and a discharge unit 16 disposed sequentially along the conveyance path 13 from the paper entrance 11 side. The printer 2 also has a controller 17 that connects to the printer 2 and controls the media conveyance unit 14, print unit 15, and discharge unit 16. The controller 17 includes a CPU 18, and a storage unit 19 including ROM and RAM.

The media conveyance unit 14 includes a tractor mechanism 21 that engages the sprocket holes and conveys the recording medium 4, a nip roller mechanism 22 that conveys the recording medium 4 in conjunction with the tractor mechanism 21, a single feed motor 23 that synchronously drives the tractor mechanism 21 and nip roller mechanism 22, and a belt transfer mechanism 24 that transfers power from the feed motor 23 to the tractor mechanism 21 and nip roller mechanism 22.

The nip roller mechanism 22 has a nip roller set 26 including a drive roller 27 and follower roller 28, and an encoder 29 that detects the conveyance distance (number of feed steps) of the recording medium 4 by the nip roller set 26. When the feed motor 23 is a stepper motor, the conveyance distance of the recording medium 4 can be converted from the number of steps, or converted from the pulse count of the encoder 29.

The tractor mechanism 21 is located near the downstream end of the paper entrance 11, and the nip roller mechanism 22 is located near the upstream end of the print unit 15. The tractor mechanism 21 and nip roller mechanism 22 are disposed with distance therebetween in the recording medium 4 conveyance direction. The recording medium 4 is thus conveyed and passed from the tractor mechanism 21 to the nip roller mechanism 22. The media conveyance speed of the nip roller mechanism 22 is designed to be slightly faster than the media conveyance speed of the tractor mechanism 21, and the recording medium 4 is thus conveyed in a tensioned state.

A media guide 31 that guides conveyance of the recording medium 4 through the conveyance path 13 is disposed between the tractor mechanism 21 and nip roller mechanism 22, and a media end detection sensor 32 that detects the leading end or the trailing end of the recording medium 4 is disposed on the downstream side of the media guide 31. A media detection sensor 33 that detects if recording medium 4 is present (is set) is also incorporated into the tractor mechanism 21.

The print unit 15 includes an inkjet head 42 disposed facing down on a carriage 41, a carriage moving mechanism 43 that moves the inkjet head 42 on the carriage 41 bidirectionally in a direction perpendicular to the recording medium 4 conveyance direction (widthwise to the recording medium 4), and a media support plate 44 (platen) that is located directly below the inkjet head 42 parallel to and opposite the nozzle face 42*a* of the inkjet head 42 with a specific gap therebetween.

An ink cartridge (not shown in the figure) is mounted on the carriage 41 above the inkjet head 42, and ink is supplied from the ink cartridge to the inkjet head 42. A nozzle row 45 (actually nozzle rows for a plurality of colors) with a plurality of ejection nozzles 45*a* arrayed in the media conveyance direction is disposed to the nozzle face 42*a* of the inkjet head 42, and a width detection sensor 46 that primarily detects the width of the recording medium 4 is disposed at a position offset to the upstream side of the nozzle row 45.

The carriage moving mechanism 43 includes two guide rods 51 that extend widthwise to the recording medium 4 and support the carriage so that it can slide freely, a timing belt 52 connected in part to the carriage, and a carriage motor 53 that drives the timing belt 52 forward and reverse. When the carriage motor 53 rotates forward and reverse, the carriage 41 travels bidirectionally guided by the two guide rods 51 across the recording medium 4 width by means of the intervening timing belt 52. The inkjet head 42 is driven to eject ink synchronously to the outbound and return trips of this bidirectional travel, thereby printing on the recording medium 4 (in the primary scanning direction).

The discharge unit 16 has a discharge roller set 61 including a drive-side discharge drive roller 62 and a follower-side star wheel 63 that rotate and slip while holding and feeding the recording medium 4, and a discharge motor 64 that causes the discharge drive roller 62 to turn. The discharge drive roller 62 located on the bottom side rotates in contact with the bottom of the recording medium 4 while applying feed pressure to the recording medium 4, and the star wheel 63 located on the top side is urged to the discharge drive roller 62 side while rotating freely in contact with the recording surface (front surface) of the recording medium 4. The media conveyance speed of the nip roller mechanism 22 is designed to be slightly slower than the media conveyance speed of the discharge drive roller 62, and the recording medium 4 is conveyed along the media support plate 44 described above with tension applied by the slipping rotation of the discharge drive roller 62 and is then conveyed to the outside of the printer (discharged) from the paper exit 12.

The basic control operation of the printer 2 executed by the controller 17 based on print jobs and control commands from the host computer 3 is described next.

Mechanical initialization occurs first after the user sets the recording medium 4 in the tractor mechanism 21. This initialization is triggered by closing the cover (not shown in the figure) of the printer 2 that covers the media conveyance unit 14, or pressing a button after closing the cover. When initialization starts and the media detection sensor 33 determines that the recording medium 4 is present, the feed motor 23 starts driving the tractor mechanism 21 and nip roller mechanism 22. As a result, the recording medium 4 set in the tractor mechanism 21 is conveyed through the conveyance path 13 to the media guide 31, nip roller mechanism 22, and the print unit 15. More specifically, the leading end of the recording medium 4 fed from the tractor mechanism 21 is detected by the media end detection sensor 32, and conveyance stops after the recording medium 4 is conveyed a specific number of steps after the leading end is detected. As a result, the leading end of the recording medium 4 stops at the position of the first nozzle (first ejection nozzle 45*a*) at the downstream end of the inkjet head 42 nozzle row 45, that is, at the initialization position 48 (initial printing position or start printing position).

The carriage 41 than travels one round trip across the recording medium 4, and the width detection sensor 46 disposed to the inkjet head 42 detects the width of the recording medium 4. The detected result is then compared with the recording medium 4 setting of the host computer 3, and if there is a mismatch, the user is prompted to change the setting or change the recording medium 4. When the carriage 41 returns to the original position, the position is detected by a sensor not shown. This determines the home position of the inkjet head 42 (carriage 41), and completes mechanical initialization.

If a print command (print job) is then received and a top margin is preset, the recording medium 4 is conveyed the distance of the top margin and the printing operation then starts. In the printing operation, the inkjet head 42 (carriage 41) ejects ink based on the print data (prints in the primary scanning direction) while travelling outbound. The print width is the length of the nozzle row 45 of the inkjet head 42, and before the inkjet head 42 returns, the discharge roller set 61 is driven in addition to the tractor mechanism 21 and nip roller mechanism 22 to advance (line feed in the secondary scanning direction) the recording medium 4 the length of the nozzle row 45 (more precisely, the length of the nozzle row plus the pitch of one nozzle). When the line feed (intermittent paper feed) equal to the length of the nozzle row 45 is completed, the inkjet head 42 returns and prints (ejects ink) in the same way as on the outbound pass.

The recording medium 4 is thus printed as desired by repeating these steps of ejecting ink (primary scanning direction) while the inkjet head 42 travels out and back, and intermittently feeding (line feed in the secondary scanning direction) the recording medium 4. The printed portion of the recording medium 4 is thus fed in steps by the discharge roller set 61 and gradually discharged to the outside of the printer from the paper exit 12.

When the recording medium 4 is a single sheet, driving the discharge roller set 61 stops and the printing operation stops when the trailing end of the recording medium 4 passes the discharge roller set 61 (after conveyance a specific number of steps after the trailing end is detected by the media end detection sensor 32).

When the recording medium 4 is continuous paper, driving the discharge roller set 61 stops when the last pass in the primary scanning direction is completed (when printing actually ends) and the printed portion is conveyed by perforated unit outside the paper exit 12. The user then separates the printed portion of the recording medium 4 at the perforation, and issues a command to reverse the recording medium 4 by pressing a button, for example. When reverse conveyance is commanded, the tractor mechanism 21, nip roller mechanism 22, and discharge roller set 61 reverse and position (index) the leading end of the recording medium 4 to the tractor mechanism 21, that is, reverse the recording medium 4 until the leading end is detected by the media detection sensor 33. The printing operation using continuous paper then ends. The user then starts the same operation described above, or replaces the recording medium 4 (replaces the paper) and then commands the same operation.

The control method used when a nonstandard short recording medium 4 is conveyed in the printer 2 according to this embodiment of the invention is described next.

As described above, the tractor mechanism 21 (first conveyance unit) and nip roller mechanism 22 (second conveyance unit) are disposed with distance therebetween, and the recording medium 4 is conveyed and passed from the tractor mechanism 21 to the nip roller mechanism 22. In the initialization operation the leading end of the recording medium 4 fed from the tractor mechanism 21 is detected by the media end detection sensor 32 (first detection unit) located near the nip roller mechanism 22, further conveyed a specific number of steps through the nip roller mechanism 22, and stopped at the initialization position (initial printing position). If the user mistakenly inserts a short recording medium 4 (cut sheet) to this configuration, the recording medium 4 may not be passed correctly from the tractor mechanism 21 to the nip roller mechanism 22.

Figure 3:
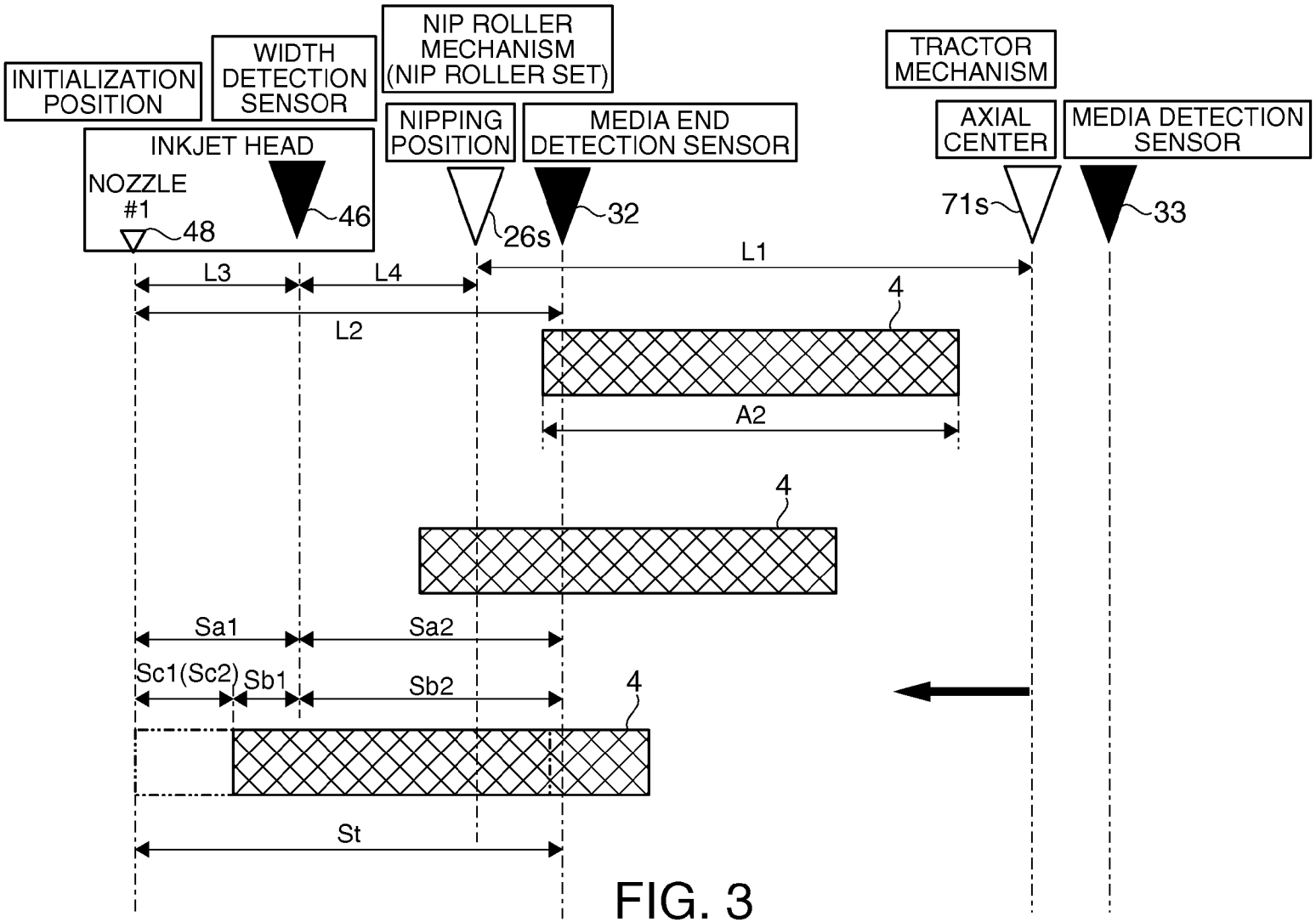
FIG. 3 is a plan view showing conveyance of a short, nonstandard recording medium.

More specifically, if a recording medium 4 that is shorter than the distance between the axial center 71*s* of the drive shaft 71 of the tractor mechanism 21 that applies drive power feeding the recording medium 4 forward and the nipping position 26*s* of the nip roller set 26 where the recording medium 4 is reliably nipped, the operation conveying the recording medium 4 a specific number of steps will be executed if the media end detection sensor 32 detects the leading end even if the recording medium 4 is not passed to the nipping position of the nip roller set 26 (see FIG. 3). A paper feed error can, of course, be detected when the paper width is detected by the width detection sensor 46 if the leading end of the recording medium 4 has not reached the initialization position 48. However, if the leading end of the recording medium 4 has reached the width detection sensor 46 but has not reached the initialization position 48 due to conveyance loss when passing the recording medium 4, a paper feed error cannot be detected and the printing operation starts. When this happens the printhead prints to a position not on the recording medium 4, and the inside of the printer or the recording medium 4 becomes soiled with ink.

Normal conveyance control when a recording medium 4 with sufficient length is conveyed in the conveyance operation initializing the recording medium 4, and special conveyance control for preventing the foregoing problem when a nonstandard short recording medium 4 is conveyed, are described below.

Figure 2:
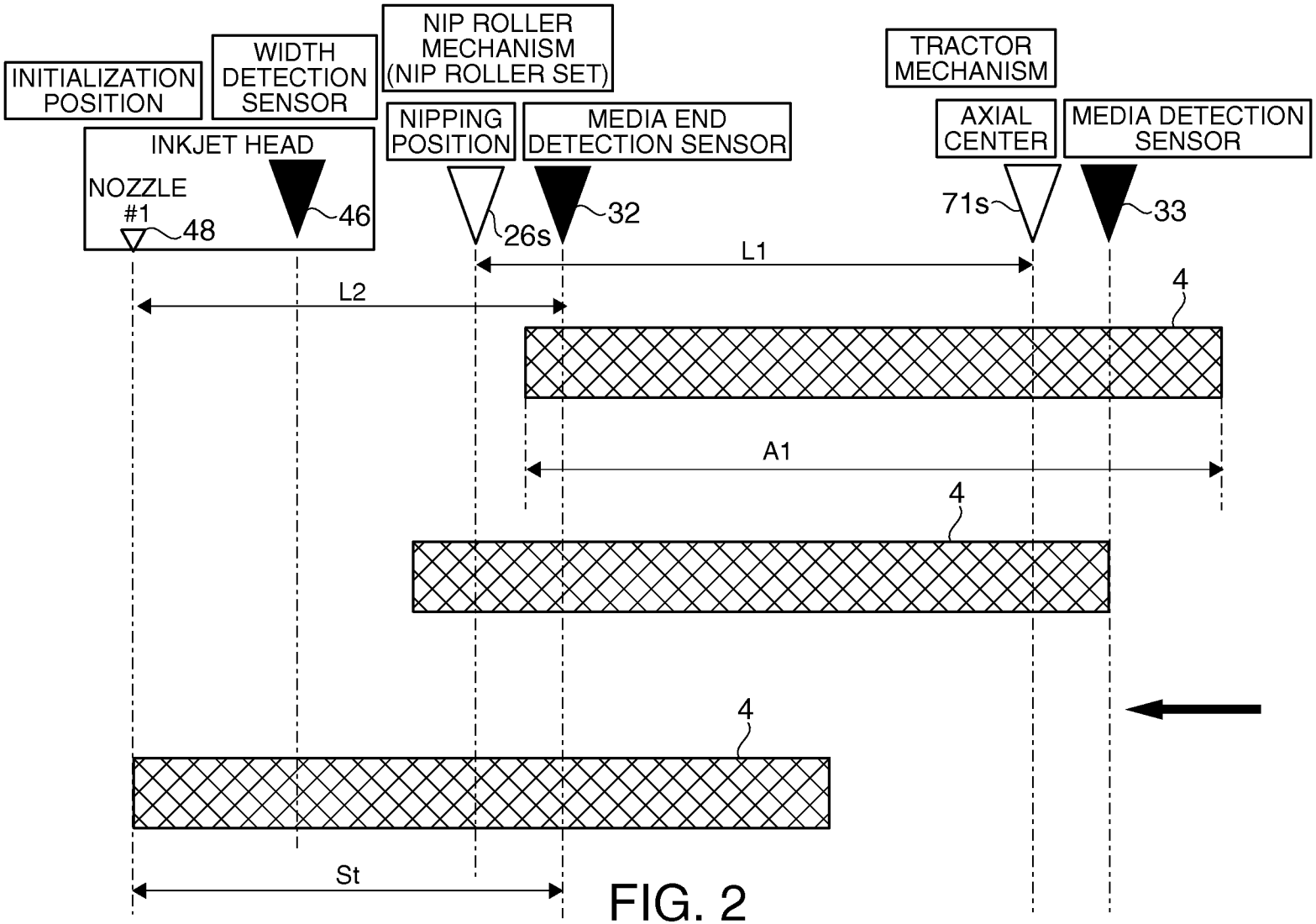
FIG. 2 is a plan view showing conveyance of a recording medium with sufficient length.

During normal conveyance control when a recording medium 4 with sufficient length is conveyed, that is, when the distance between the axial center 71*s* and the nipping position 26*s* is L1, the length of the recording medium 4 is A1, and A1>L1 as shown in FIG. 2, the leading end of the recording medium 4 reaches the nipping position 26*s* before the trailing end of the recording medium 4 reaches the axial center 71*s*, and the recording medium 4 is passed desirably to the nip roller set 26. As a result, the recording medium 4 is advanced a specific number of steps St equal to the distance L2 between the media end detection sensor 32 and the initialization position 48 (position of the first nozzle) after the media end detection sensor 32 detects the leading end. The recording medium 4 therefore stops with its leading end at the initialization position 48. This initialization position 48 is the home position for starting printing.

However, during special control when a short recording medium 4 is supplied, that is, when the length A2 of the recording medium 4 is shorter than the distance L1 between the axial center 71*s* and nipping position 26*s* (A2<L1) as shown in FIG. 3, the leading end of the recording medium 4 will not reach the nipping position 26*s* even after the trailing end of the recording medium 4 passes the axial center 71*s*, and the recording medium 4 will not be correctly passed to the nip roller set 26. More specifically, the recording medium 4 propelled by the drive force of the tractor mechanism 21 will move slightly towards the nipping position 26*s* due to inertia after separating from the tractor mechanism 21. The recording medium 4 may therefore stop between the axial center 71*s* and nipping position 26*s*, but may also reach the nipping position 26*s* and be nipped and conveyed further forward by the nip roller set 26. However, because conveyance stops a specific number of steps St after the media end detection sensor 32 detects the leading end, the recording medium 4 may stop with the leading end just passed the nipping position 26*s* or before the initialization position 48 if there is any conveyance loss when the recording medium 4 is passed.

When conveying the recording medium 4 for initialization, the width detection sensor 46 (second detection unit) is used as a leading end detection sensor and conveyance is controlled to compensate as needed for variations in the position where the recording medium 4 stops.

Because this control method uses the width detection sensor 46 as a leading end detection sensor, the inkjet head 42 (width detection sensor 46) is moved by the carriage 41 to the center of the recording medium 4 width when the recording medium 4 is conveyed for initialization.

As shown in FIG. 3, a first reference step count Sa1, which is the number of steps (first reference conveyance distance) equal to the distance L3 between the width detection sensor 46 and initialization position 48 in the recording medium 4 conveyance direction, is acquired (first reference distance acquisition unit). More specifically, a recording medium 4 with sufficient length is fed and conveyed for initialization, the number of steps from when the width detection sensor 46 detects the leading end until the recording medium 4 stops at the initialization position 48 is counted, and this count is acquired and stored as the first reference step count Sa1 in the storage unit 19 of the controller 17 (control unit) (see FIG. 1). Alternatively, the specific number of steps St equal to the distance L2 between the media end detection sensor 32 and initialization position 48 could be applied to distance L3 to calculate first reference step count Sa1. Note that the first reference distance acquisition unit is rendered by the controller 17.

The conveyance control method is described next with reference to FIG. 4A. This embodiment of the invention can appropriately choose between a first control method (shown in FIG. 4A) and a second control method (FIG. 4B). Note that this conveyance control is based on the width detection sensor 46 detecting the leading end, and a paper feed (conveyance) error is returned if the leading end is not detected by the width detection sensor 46, media end detection sensor 32, or media detection sensor 33.

Figure 4A:
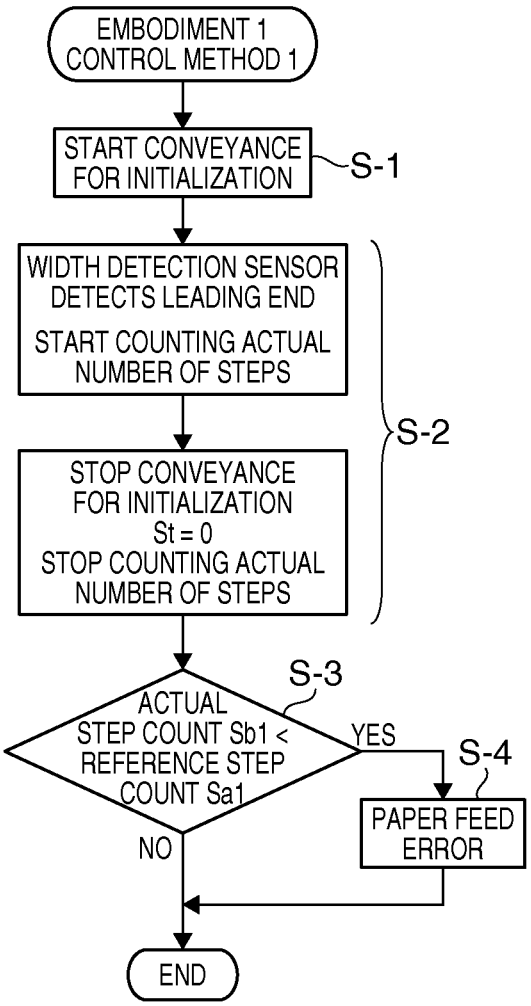
FIGS. 4A and 4B are flow charts of media conveyance control according to a first embodiment of the invention.
Figure 4B:
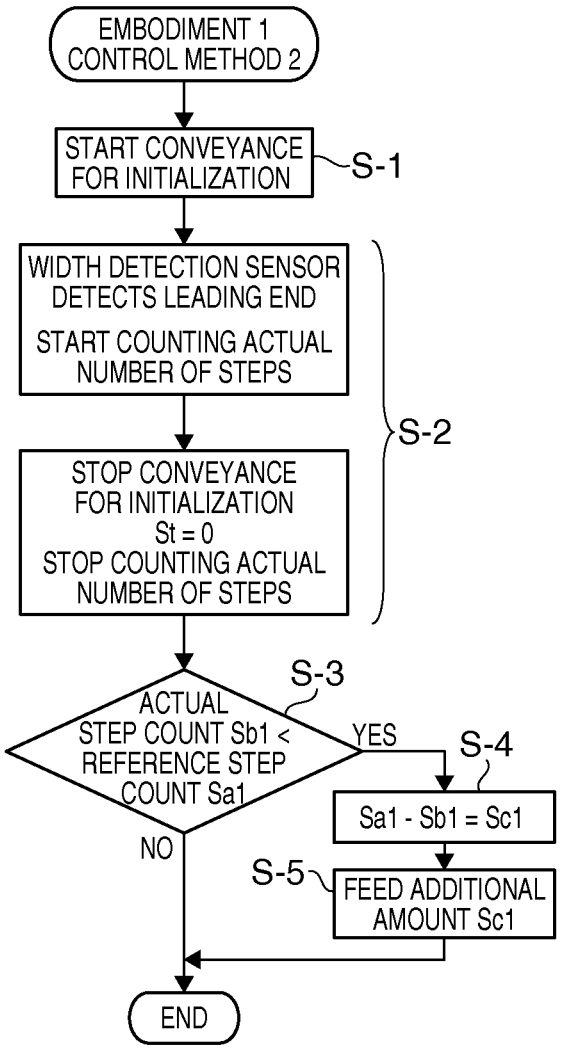

As shown in FIG. 4A, the first control method first starts conveying the recording medium 4 (S-1), counts the actual number of steps (first actual conveyance distance) from detection of the leading end by the width detection sensor 46 until recording medium 4 conveyance stops, and saves this count as the first actual conveyance step count Sb1 (S-2, first actual measurement unit). The measured first actual conveyance step count Sb1 and the first reference step count Sa1 stored in the storage unit 19 are then compared (S-3, evaluation unit). If first actual conveyance step count Sb1 is less than first reference step count Sa1, that is, when Sb1<Sa1, the leading end of the recording medium 4 has not reached the initialization position 48, and a paper feed error is returned (S-4, paper feed error). Note that the first actual measurement unit and the evaluation unit are rendered by the controller 17. When a paper feed error occurs, the control unit presents (reports) an error message on a display or other means, and stops the following printing operation (cancels printing). As a result, printing outside the recording medium 4 can be prevented. Note that the recording medium 4 is preferably discharged after the printing operation is cancelled.

As shown in FIG. 4B, the second control method compares the first actual conveyance step count Sb1 and first reference step count Sa1 (S-3, evaluation unit) in the same way as in the first control method, and if Sb1<Sa1, and calculates the remaining conveyance step count Sc1, which is the number of conveyance steps equal to the first reference step count Sa1 minus the first actual conveyance step count Sb1 (S-4). The control unit then additionally conveys the recording medium 4 a distance equal to the remaining conveyance step count Sc1 (S-5, complementary conveyance). As a result, the leading end of the recording medium 4 reaches the initialization position 48, and even short, nonstandard recording media 4 can be positioned so that the following printing operation can be completed normally. Note that a slower conveyance speed than is used in the normal initialization conveyance is used in this complementary conveyance so that slipping does not occur when conveyance starts again. When Sb1<Sa1, or when the media is conveyed additionally as described above, a paper feed error could also be presented on the display and the user prompted to select whether to continue the printing operation.

The first control method (FIG. 5A) and second control method (FIG. 5B) of a second embodiment of the invention are described next.

This control method acquires a second reference step count Sa2, which is the number of conveyance steps (second reference conveyance distance) equal to the distance L4 between the media end detection sensor 32 and width detection sensor 46 (second reference distance acquisition unit). As in conveyance control in the first embodiment, this control method is based on the width detection sensor 46 detecting the leading end. The second reference distance acquisition unit is rendered by the controller 17.

Figure 5A:
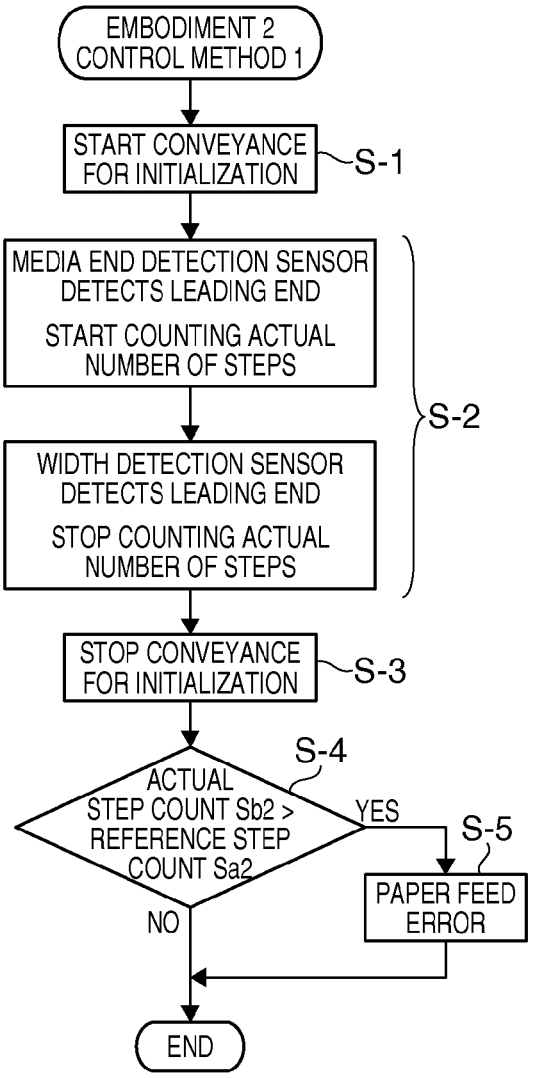
FIGS. 5A and 5B are flow charts of media conveyance control according to a second embodiment of the invention.

As shown in FIG. 5A, this first control method counts the actual number of steps (second actual conveyance distance) from detection of the leading end by the media end detection sensor 32 until detection of the leading end by the width detection sensor 46 during the time from the start of recording medium 4 conveyance (S-1) until conveyance stops, and saves this count as the second actual conveyance step count Sb2 (S-2, second actual measurement unit). Conveyance of the recording medium 4 ends when St=0 (S-3). This measured second actual conveyance step count Sb2 is then compared with the second reference step count Sa2 stored in the storage unit 19 (S-4, evaluation unit). When the second actual conveyance step count Sb2 is greater than the second reference step count Sa2, that is, when Sb2>Sa2, the leading end of the recording medium 4 has not reached the initialization position 48, and a paper feed error is returned (S-5, paper feed error). Note that the second actual measurement unit and the evaluation unit are rendered by the controller 17.

As described above, when a paper feed error occurs, the control unit presents (reports) an error on a display or other means, and stops the following printing operation (cancels printing). As a result, printing outside the recording medium 4 can be prevented. Note that the recording medium 4 is preferably discharged after the printing operation is cancelled.

Figure 5B:
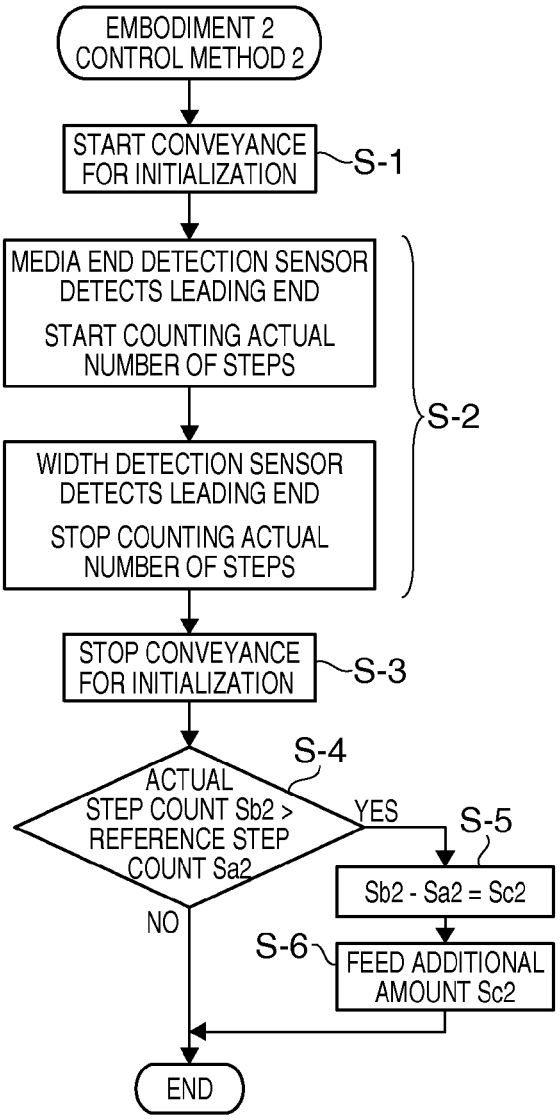

As shown in FIG. 5B, the second control method compares second actual conveyance step count Sb2 and second reference step count Sa2 (S-4, evaluation unit). If Sb2>Sa2, the remaining conveyance step count Sc2, which is the number of conveyance steps equal to the second actual conveyance step count Sb2 minus the second reference step count Sa2, is obtained (S-5). If the conditions are the same, the remaining conveyance step count Sc2 in this second embodiment and the remaining conveyance step count Sc1 in the first embodiment will be the same. The control unit then additionally conveys the recording medium 4 a distance equal to the remaining conveyance step count Sc2 (S-6, complementary conveyance). As a result, the leading end of the recording medium 4 reaches the initialization position 48. Note that a slow conveyance speed used in this case as described above so that slipping does not occur when conveyance starts again. Printing outside the recording medium 4 can also be prevented in this case. When Sb2>Sa2, or when the media is conveyed additionally as described above, a paper feed error could also be presented on the display and the user prompted to select whether to continue the printing operation.

Knowing that conveyance loss can occur between the tractor mechanism 21 and nip roller mechanism 22 when a nonstandard short recording medium 4 is supplied, this embodiment of the invention measures this conveyance loss as the difference between the first actual conveyance step count Sb1 and first reference step count Sa1, or between the second actual conveyance step count Sb2 and second reference step count Sa2, and can appropriately process (handle) paper feed errors or additional conveyance when the recording medium 4 is not conveyed normally. Printing outside the recording medium 4 can therefore be effectively prevented, and printing normally to nonstandard short recording media 4 is possible.

The foregoing embodiments particularly describe a special control method used when a short, nonstandard recording medium 4 is supplied, but this control method can also be used when a standard recording medium 4 is supplied. For example, conveyance control of the standard recording medium 4 shown in FIG. 2 could confirm that Sb1=Sa1 or Sb2=Sa2. These embodiments also focus on the recording medium 4 not being conveyed to the initialization position 48, but the invention can also be applied to when the recording medium 4 overruns the initialization position 48 (when the actual conveyance distance exceeds the reference conveyance distance). Reversing (reverse conveyance) of the recording medium 4 is also considered in addition to paper feed error in this situation.

The printing system 1 described above can also be rendered as a single device.

The invention being thus described, it will be obvious that it may be varied in many ways. Such variations are not to be regarded as a departure from the spirit and scope of the invention, and all such modifications as would be obvious to one skilled in the art are intended to be included within the scope of the following claims.

What is claimed is:

1. A method of controlling a printing device that has a first conveyance unit, first detection unit, second conveyance unit, second detection unit, and print unit disposed sequentially from the upstream side of the recording medium conveyance direction, conveys the recording medium fed from the first conveyance unit a specific conveyance distance after the leading end is detected by the first detection unit, and stops conveyance after conveying the leading end of the recording medium passed the second conveyance unit, second detection unit, and print unit to an initial printing position;

the control method comprising:

a second reference distance acquisition step that gets a second reference conveyance distance equal to the distance between the first detection unit and second detection unit in the specific conveyance distance;

a second actual distance measurement step that measures the second actual conveyance distance of the recording medium during actual conveyance from detection of the leading end by the first detection unit to detection of the leading end by the second detection unit;

an evaluation step that compares the second reference conveyance distance and the second actual conveyance distance, and determines if conveyance error occurred during recording medium conveyance; and, the evaluation step determines conveyance error occurred if the second actual conveyance distance is greater than or less than the second reference conveyance distance; and a complementary conveyance step that conveys the recording medium an additional remaining conveyance distance equal to the second actual conveyance distance minus the second reference conveyance distance when conveyance error is detected because the second actual conveyance distance is greater than the second reference conveyance distance.

2. The method of controlling a printing device described in claim 1, further comprising:

a cancellation step that cancels printing by the print unit when conveyance error occurs.

3. The method of controlling a printing device described in claim 1, wherein:

the complementary conveyance step conveys the additional distance at a lower speed than the conveyance speed when conveying the specific conveyance distance.

4. A printing device comprising:

a first conveyance unit, first detection unit, second conveyance unit, second detection unit, and print unit disposed sequentially from the upstream side of the recording medium conveyance direction; and a control unit that conveys the recording medium fed from the first conveyance unit a specific conveyance distance after the leading end is detected by the first detection unit, and stops conveyance after conveying the leading end of the recording medium passed the second conveyance unit, second detection unit, and print unit to an initial printing position, and includes a second reference distance acquisition unit that gets a second reference conveyance distance equal to the distance between the first detection unit and second detection unit in the specific conveyance distance, a second actual distance measurement unit that measures the second actual conveyance distance of the recording medium during actual conveyance from detection of the leading end by the first detection unit to detection of the leading end by the second detection unit, an evaluation unit that compares the second reference conveyance distance and the second actual conveyance distance, and determines if conveyance error occurred during recording medium conveyance, the evaluation unit determines conveyance error occurred if the second actual conveyance distance is greater than or less than the second reference conveyance distance, and the control unit drives complementary conveyance that conveys the recording medium an additional remaining conveyance distance equal to the second actual conveyance distance minus the second reference conveyance distance when the evaluation unit detects conveyance error because the second actual.

5. The printing device described in claim 4, wherein:

the control unit cancels printing by the print unit when the evaluation unit detects conveyance error.

* * * * *